US005109644A

United States Patent [19]

Poremba

[11] Patent Number: 5,109,644

[45] Date of Patent: May 5, 1992

[54] GLASS BLOCK FOR USE AS A CORNERSTONE OR AN END BLOCK

[75] Inventor: Hans-Herbert Poremba, Dernbach, Fed. Rep. of Germany

[73] Assignee: Westerwald AG fur Silikatindustrie, Wirges, Fed. Rep. of Germany

[21] Appl. No.: 651,591

[22] Filed: Feb. 7, 1991

[30] Foreign Application Priority Data

Feb. 23, 1990 [EP] European Pat. Off. ..... 90103593.1

[51] Int. Cl.[5] ..... E04C 1/42

[52] U.S. Cl. ..... 52/306; 52/307

[58] Field of Search ..... 52/306

[56] References Cited

U.S. PATENT DOCUMENTS

| | | | |
|---|---|---|---|
| D. 109,025 | 3/1938 | Perkins | 52/306 |
| 2,194,756 | 3/1940 | Kell | 52/306 |
| 2,288,521 | 6/1942 | Gregory | 52/306 |
| 2,290,088 | 7/1942 | Bleakley | 52/306 |
| 2,322,591 | 6/1943 | Rapp | 52/306 |
| 2,355,262 | 8/1944 | Blau | 52/306 |
| 2,724,260 | 11/1955 | D'Eustachio | 52/306 |
| 4,651,486 | 3/1987 | Erickson et al. . | |
| 4,719,735 | 1/1988 | Fleming, Jr. et al. | 52/306 |
| 4,852,321 | 8/1989 | Fleming, Jr. et al. | 52/306 |

FOREIGN PATENT DOCUMENTS 0320077 6/1989 European Pat. Off. .

*Primary Examiner*—Richard E. Chilcot, Jr.
*Assistant Examiner*—Joanne C. Downs
*Attorney, Agent, or Firm*—Brumbaugh, Graves, Donohue & Raymond

[57] ABSTRACT

A glass block (10) consists of two halves (12,14) fused together along a vertical center plane (11) of the block and having planar inclined surfaces (22,24) at a vertically extending end face (42), the inclined surfaces forming an angle of 45° with the vertical center plane (11). The opposite vertical end face (44) of the glass block is substantially flat. The inclined surfaces (22, 24) extend up to the vertical center plane (11) of the glass block so as to make the same suitable for use as a cornerstone and as an end block.

4 Claims, 2 Drawing Sheets

GLASS BLOCK FOR USE AS A CORNERSTONE OR AN END BLOCK

The invention relates to a glass block consisting of two halves fused together along a vertical center plane of the block and having planar inclined surfaces at a vertically extending end face, the inclined surfaces forming an angle of 45° with the vertical center plane, while the opposite vertical end face of the glass block is substantially flat.

Such a glass block is known from EP-A-0320077. In that case two planar inclined surfaces extend at an angle of approximately 45° with respect to a vertical center plane, and the inclined surfaces pass over into an end face of the block which is at right angles to the vertical center plane of the block.

The term "vertical" as used in the instant application refers to the glass block when installed, as intended, in a vertical wall.

The glass block known from EP-A-0320077 can be used as a socalled terminal or end block. An end block is understood to be a block which presents the lateral termination of a wall.

It is the object of the invention to modify a glass block of the kind mentioned initially such that it can be produced economically, being useful both as an end block and as a cornerstone, giving the resulting wall end or corner a pleasant appearance.

That object is met, in accordance with the invention, in a glass block consisting of two halves fused together along a vertical center plane of the block and having planar inclined surfaces at a vertically extending end face, the inclined surfaces including an angle of 45° with the vertical center plane, while the opposite vertical end face of the glass block is substantially flat, in that the inclined surfaces extend as far as the vertical center plane of the glass block.

In cotradistinction to the prior art mentioned above, the inclined planar surfaces provided according to the invention thus extend without any bend or curvature up to the vertical center plane of the block.

In accordance with a preferred modification of the invention, a groove runs between the inclined surfaces in the area of the center plane. This means that the inclined surfaces reach as far as the vertical center plane of the glass block, with the exception of the groove mentioned.

U.S. Pat. No. 4,651,486 discloses a glass brick which likewise consists of two identical halves fused together along a vertically extending center plane. However, the glass brick described in that publication is symmetrical not only with respect to a vertical center plane of the brick but also with respect to a plane extending at right angles to the vertical center plane.

The glass block according to the invention can be used as the terminal brick of a wall and also as a cornerstone for interconnecting two walls built at right angles to each other. In both events it will create an esthetically pleasant appearance.

An embodiment of the invention will be described in greater detail below with reference to the drawing, in which.

The glass block 10 illustrated in the figures is made of two identical halves 12, 14 which are fused together along a circumferential seam 16. Therefore, to make a glass block 10, first two halves 12, 14 which are approximately dish-shaped are prepared independently. The edges of these halves 12, 14 then are fused and bonded together in the region of the seam 16 to provide the finished glass block 10 which is hollow inside.

Figure 1:
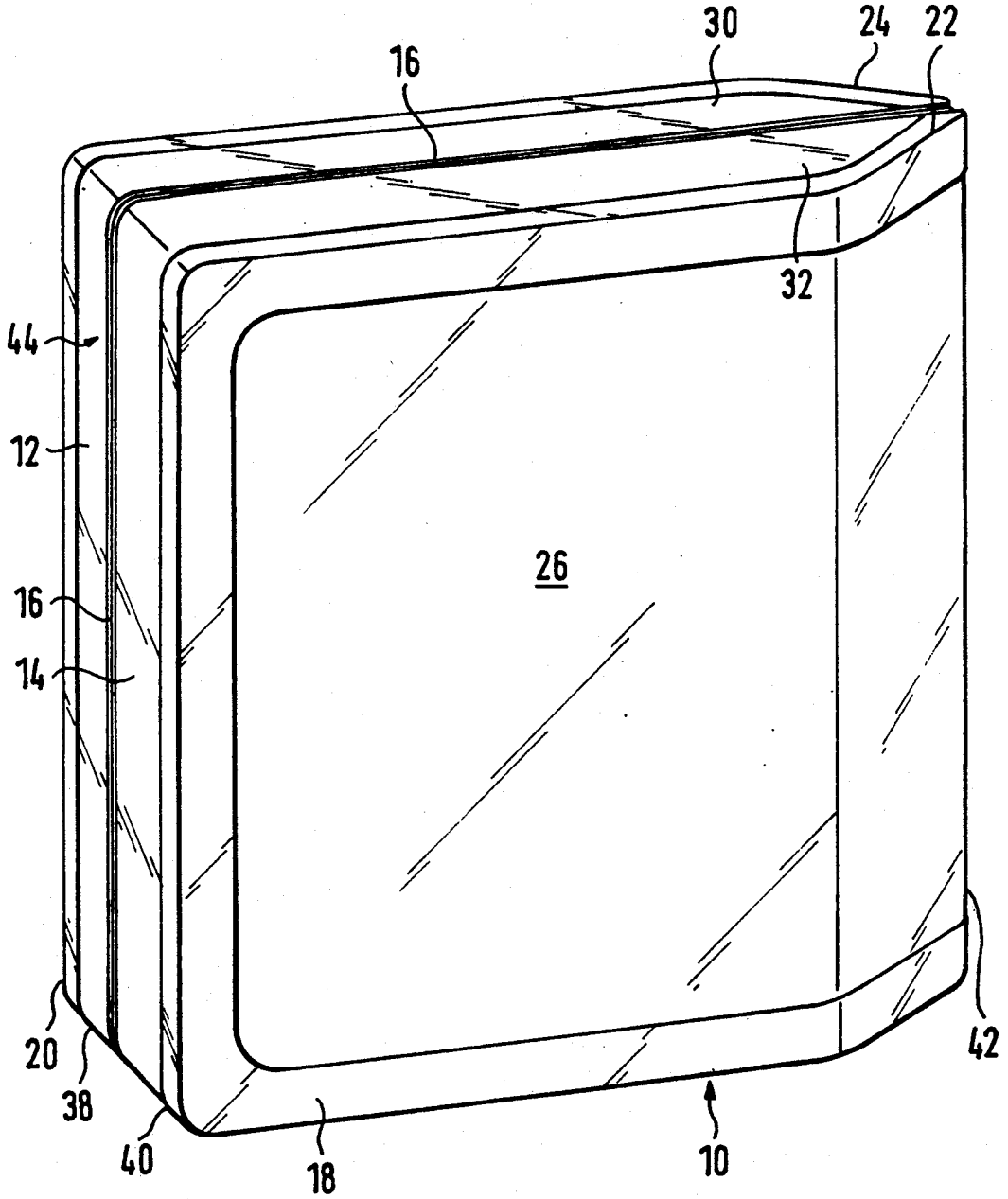
FIG. 1 is a diagrammatic perspective view of a glass block.

The glass block 10 may be used without any alterations both as a cornerstone to interconnect two walls which are erected at right angles with respect to each other (FIG. 2) and as an end block for a free wall edge (FIG. 1).

The glass block 10 is formed with beads 18, 20 along both sides.

Figure 2:
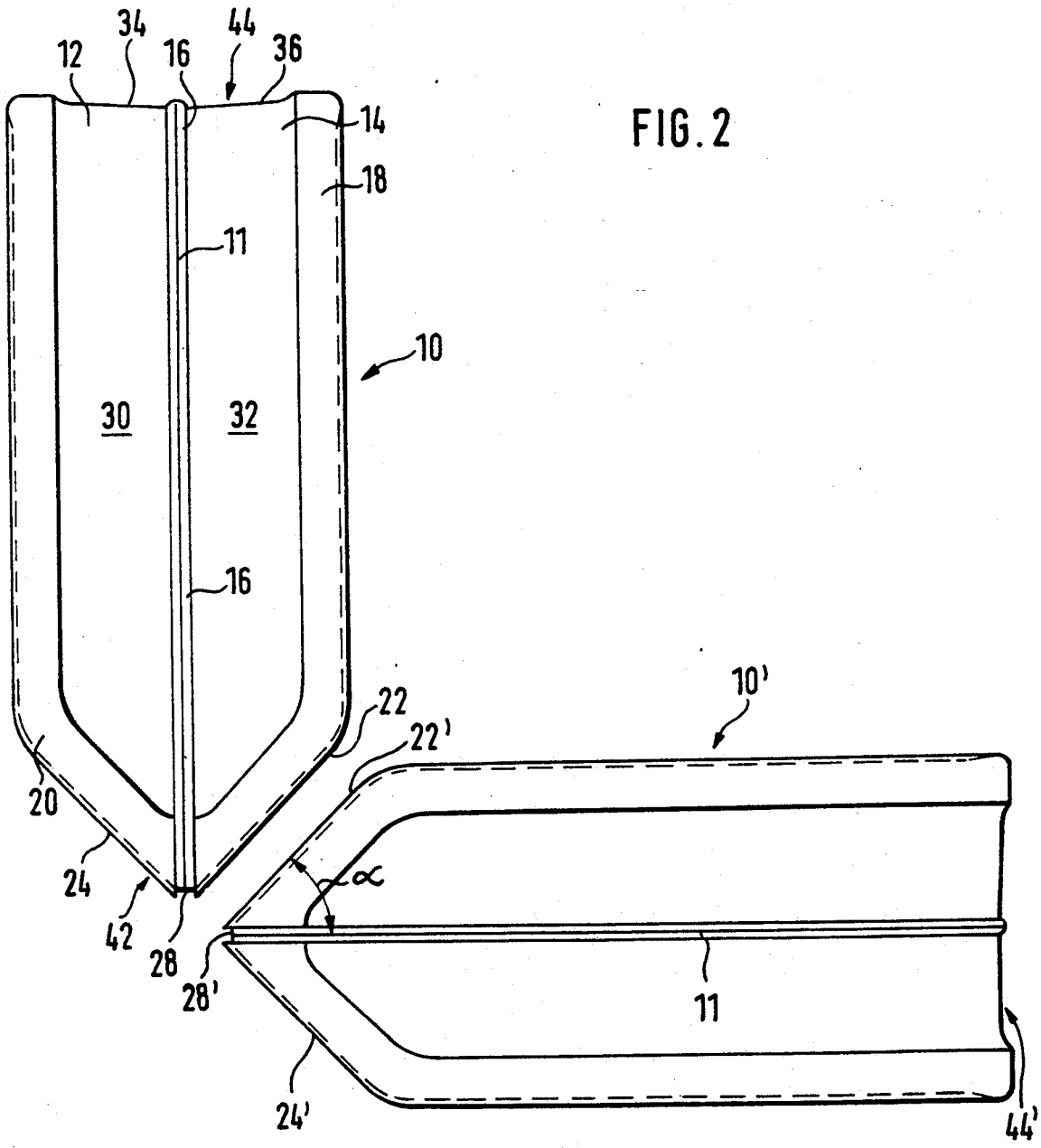
FIG. 2 is a diagrammatic horizontal sectional view of two glass blocks.

As shown especially in FIG. 2, each glass block has two inclined surfaces 22, 24 in the area of a vertically extending edge. The inclined surfaces 22, 24 extend vertically with respect to the vertical center plane 11 of each glass block 10. Only an inwardly directed groove 18 remains free in the region of the center plane 11. When the glass block is installed, this groove may take up mortar and the like.

The side faces 26 of the glass brick are slightly depressed with respect to the circumferential bead 18, as indicated by the dashed lines in FIG. 2.

The upper surfaces 30, 32 of the two halves 12, 14 of the glass block 10 likewise are fused together along the seam and are substantially flat, apart from the projecting bead.

The same is true of the bottom surfaces 38, 40 of the glass block.

As shown particularly in FIG. 2, the glass block 10 includes the end face 42 already mentioned which is composed of the converging inclined surfaces 22, 24. The opposite vertical end face 44 of the glass block is made up of surfaces 34, 36 extending at an angle slightly differing from 90° with respect to the vertical center plane 11, as may be seen in FIG. 2.

FIG. 2 demonstrates how two glass blocks 10, 10' are joined to make a corner. To accomplish that, two respective inclined surfaces 22, 22' are positioned next to each other (in FIG. 2 they are still spaced apart) so that the corresponding opposed inclined surfaces 24, 24' will form a continuous smooth plane.

FIG. 1 illustrates a glass block 10 as an end block, the end face 42 with the inclined surfaces 22, 24 presenting the free exposed end of a wall.

What is claimed is:

1. A glass block consisting of two halves fused together along a vertical center plane of the block and having planar converging inclined surfaces at a vertically extending end face, the inclined surfaces including an angle of 45° with said vertical center plane, the opposite vertical end face of the glass block being substantially flat, wherein said planar converging inclined surfaces extend substantially to said center plane of the glass block.

2. The glass block as claimed in claim 1, wherein said block has a groove which runs between confronting edges of said planar converging inclined surfaces.

3. A glass block for use both as a cornerstone to interconnect two vertically-oriented walls which are erected at right angles with respect to each other and as an end block for a free edge of a vertically-oriented wall, comprising:

substantially parallel planar upper and lower walls spaced from each other, a pair of side walls which are perpendicular and joined to said upper and lower walls, a substantially flat rear end wall positioned between and perpendicularly joined to said side walls and to said upper and lower walls, said block being formed of two identical halves fused together along a vertical center plane which is parallel to and equidistant from said side walls, said side walls each having a planar surface extending forwardly from said rear end wall in parallel, spaced relation with each other and converging at a predetermined distance from said rear end wall toward each other at an angle of 45° with said vertical center plane and extending substantially to said center plane for forming a front end face consisting of vertically extending inclined planar surfaces which are perpendicular to each other.

4. A glass block as claimed in claim 3, wherein each of said inclined planar surfaces have substantially parallel vertically-oriented edges spaced from each other which define therebetween a mortar receiving groove which is substantially coplanar with the center plane of said block.

* * * * *